US005220115A

United States Patent [19]

Wales et al.

[11] Patent Number: 5,220,115

[45] Date of Patent: Jun. 15, 1993

[54] DUAL CYLINDER REVOLVER

[76] Inventors: John Wales, 23211 Smith Rd.; Murry I. Rozansky, 23165 Smith Rd., both of Chatsworth, Calif. 91311

[21] Appl. No.: 808,449

[22] Filed: Dec. 16, 1991

[51] Int. Cl.[5] ..... F41C 3/14

[52] U.S. Cl. ..... 42/59; 42/62; 42/68

[58] Field of Search ..... 42/59, 62, 68; 89/13.05

[56] References Cited

U.S. PATENT DOCUMENTS

| | | | |
|---|---|---|---|
| 34,703 | 3/1862 | Sneider | 42/65 |
| 52,248 | 1/1866 | Josselyn | 42/60 |
| 142,175 | 8/1873 | Philip | 42/61 |
| 148,742 | 3/1874 | Orr | 42/63 |
| 191,178 | 5/1877 | Richardson | 42/65 |
| 217,218 | 7/1879 | Hodges et al. | 42/59 |
| 467,558 | 1/1892 | Pecker | 42/59 |
| 524,743 | 8/1894 | Pecker | 42/64 |
| 627,966 | 7/1899 | Behr | 42/59 |
| 630,478 | 8/1899 | Behr | 42/65 |
| 1,169,121 | 1/1916 | Bryn | 42/59 |
| 1,898,237 | 2/1933 | Bocco | 42/59 |
| 2,004,925 | 6/1935 | Carrillo | 89/13.05 |
| 2,830,397 | 4/1958 | Mulno | 42/62 |
| 4,468,876 | 9/1984 | Ghisoni | 42/65 |
| 4,697,368 | 10/1987 | Williams | 42/59 |
| 4,771,561 | 9/1988 | Waiser | 42/59 |

FOREIGN PATENT DOCUMENTS

| | | | |
|---|---|---|---|
| 1359 | of 1855 | United Kingdom | 42/59 |

*Primary Examiner*—Stephen C. Bentley

*Attorney, Agent, or Firm*—James Bartholomew

[57] ABSTRACT

A revolver is provided with two cylinders, each of which is alignable in a firing position, a storage position, or a loading position. The cylinders are carried by a crane that pivots to orient the cylinders in a selected one of the above three positions. When one cylinder is in the firing position, the other cylinder will be in the storage position. A cartridge retaining ring secures cartridges within a cylinder as the cylinder travels from the storage position to the firing position. An ejector mechanism is provided on each cylinder to expel spent cartridges from cylinder chambers. Advantageously, the two cylinders can be loaded with two different types of ammunition.

22 Claims, 5 Drawing Sheets

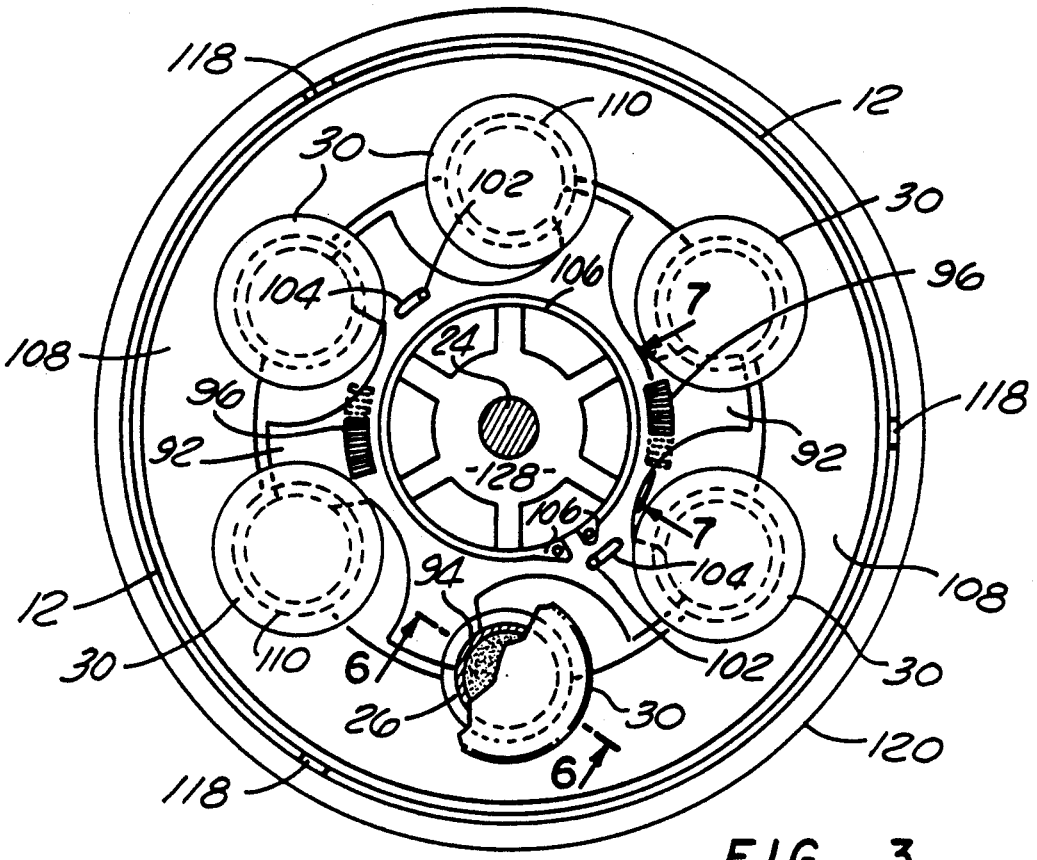
FIG. 3
FIG. 3A
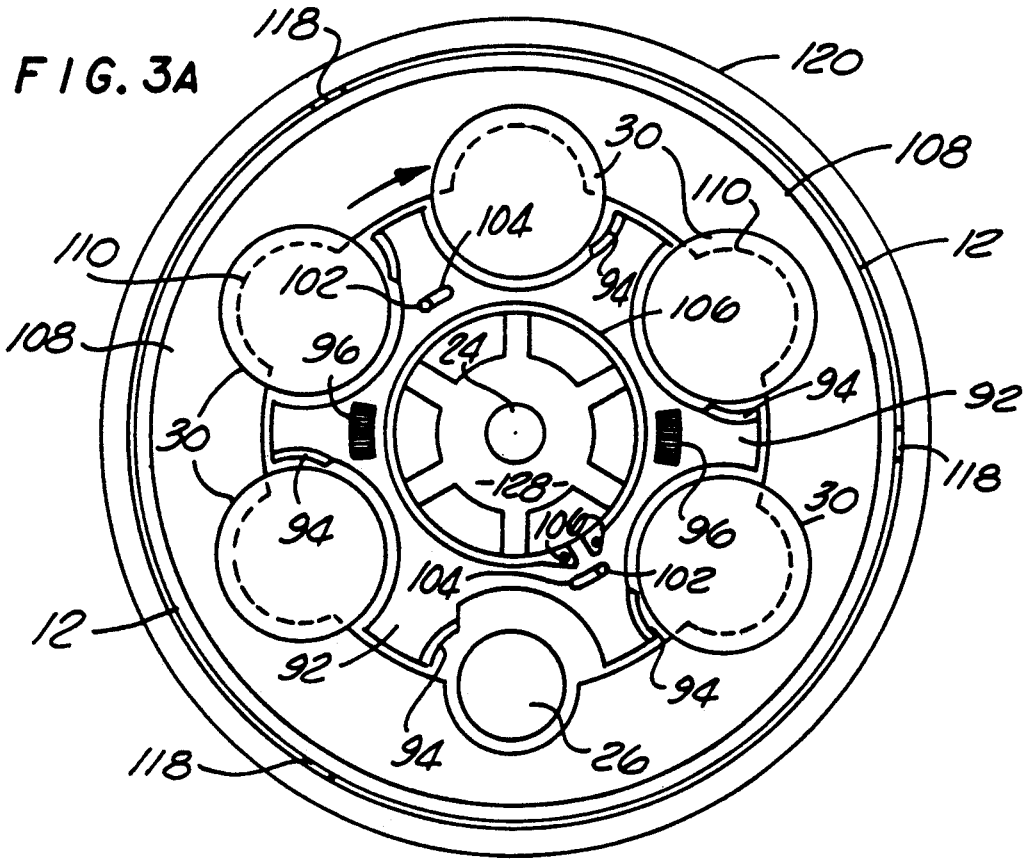

DUAL CYLINDER REVOLVER

BACKGROUND OF THE INVENTION

This invention relates generally to revolving firearms characterized by a many chambered cylinder that revolves to bring its chambers successively in alignment with the fire-arm barrel and firing mechanism. More particularly, this invention relates to a revolver-type firearm or handgun loadable with an elevated number of cartridges because the invention features the provision of two cartridge-carrying cylinders. The dual cylinder revolver of the present invention advantageously enables the revolver to be loaded with two different kinds of ammunition, for example, with one cylinder carrying regular bullets while the other cylinder holds non-lethal ammunition such as stun pellets, tranquilizer shells, etc., so that, for example, a law enforcement agent has the option to fire either disabling ammunition or lethal ammunition. The different cylinders carrying different ammunition types can be distinguished by, for example, different color markings and/or different exterior surface contours. Thus, the present invention beneficially provides more firing capacity than a conventional, single cylinder revolver, while also allowing two different cartridge types to be loaded, each into a distinctive cylinder, thereby avoiding the confusion which would be associated with loading different cartridge types into the same cylinder.

Conventionally, revolver-type firearms generally have a single cylinder accommodating a limited number of cartridges, usually between five and nine, in respective chambers. Over the years, a number of attempts have been made to provide a handgun with expanded firing capacity. One general past approach to increasing the cartridge capacity of a handgun was to provide an enlarged or unconventional cylinder capable of holding more bullets. Exemplary of past revolving firearms having a revolving cylinder with an increased number of chambers are U.S. Pat. Nos. 217,218; 524,743; 1,898,237; and 4,468,876. In general, prior firearms that employ an enlarged cylinder or a cylinder otherwise adapted to carry more than the conventional number (between 5–9 inclusive) of cartridges are less than ideal. For example, an enlarged cylinder, when utilized in prior handguns, was often found to disadvantageously cause the distribution of handgun mass to be unbalanced, thereby undesirably giving rise to objectionable kicks when the gun is fired.

Another previous approach to increase the firing capacity of revolving type firearms involved providing a plurality of coaxially mounted cartridge holders. For example, U.S. Pat. Nos. 142,175 and 148,742 each illustrate multiple cartridge-carrying cylinders arranged in series along a common axis. Another variation o those prior firearms which can be characterized as having multiple coaxial cartridge holders involves a previous firearm type wherein two coaxial cartridge holders are embodied in a central cylinder encompassed by a coaxial, cartridge-holding outer ring that surrounds the central cylinder.

Yet another previous approach to enable a firearm to carry and fire an increased number of cartridges can be characterized as utilizing an "endless" chain of cartridge holders, or the functional equivalent thereof U.S. Pat. Nos. 52,248 and 1,169,121 although each different, illustrate firearms that provide increased firing capacity by embodying an "endless" chain of cartridge holders.

It is worth noting that many of the prior attempts to provide a revolving firearm with increased firing capacity, by employing an increased number of cartridge holders or cylinders, are inventions from the 1800's or early 1900's. (Note most of the U.S. Patents cited above.) Such previous approaches have long since faded into the past, indicating that most prior firearms embodied to provide for extra firing capacity are less than ideal in design and/or functionality. A longstanding problem in the firearm art was to provide for an increase in the number of cartridges that could be carried and fired by the firearm.

Many felt this problem was adequately solved by the invention of the automatic firearm which can be loaded with an increased number of cartridges carried in a "clip" or "magazine". Typically, an automatic handgun will be loadable with a magazine that holds more cartridges (usually twelve) than a conventional six or nine shot revolver. However, automatic firearms also have problems associated therewith, and thus may not provide the ideal solution to the goal of increasing the firing capacity of a firearm. For example, a major problem with automatic firearms is their potential to "jam" such that their firing mechanism is locked in an inoperable state and unable to fire cartridges. The potential of automatic firearms to "jam" unfortunately renders such weapons as less than 100% reliable, thus undermining the confidence of law enforcement agents in many automatic firearms. Moreover, gun users claim that shooting the automatic firearm disadvantageously involves a more difficult firing procedure. Another drawback associated with automatic weapons is that the gun user cannot switch to a different type of ammunition (e.g. from stun cartridges to lethal, expanding bullets) without changing ammunition clips. The present invention advantageously allows two different types of ammunition to be readily available at all times, without requiring a reloading step.

The benefit of providing a firearm that can be loaded with two different types of ammunition should not be overlooked or underestimated. Many lives could be saved if law enforcement agents had non-lethal ammunition readily available as well as the lethal cartridges normally carried. In such a case, the non-lethal ammo, e.g. stun pellets, could be used to merely subdue a criminal who otherwise might have been seriously wounded if only regular ammunition was loaded in the law enforcer's weapon. Advantageously, the dual cylinder revolver of the present invention allows a first cylinder to be loaded with one ammunition type, while a second cylinder is loaded with a different type of ammo. The user of the dual cylinder revolver can quickly and easily switch from one cylinder to the other, thereby advantageously allowing for a change in the type of cartridge to be fired.

There exists, therefore, a significant need for a dual cylinder revolver which provides two different types of ammunition, if desired, and that provides for an increased number of available firable cartridges once both cylinders are fully loaded. Moreover, such a needed dual cylinder revolver should be reliable in operation, without being excessively mechanically complex. The present invention fulfills these needs and provides further related advantages.

SUMMARY OF THE INVENTION

The present invention resides in a dual cylinder revolver that carries extra ammunition for increased firing capacity. Advantageously, a fully loaded dual cylinder revolver allows for two different types of ammunition cartridges to be readily available to the firearm user. Beneficially, the gun frame of the present invention accommodates and carries the two cylinders in a manner which maintains a compact gun profile that is not unwieldy or unbalanced. The present invention also features a novel ejection mechanism that allows for quick and easy removal of spent cartridges from the cylinder chambers, and a novel cartridge retaining apparatus which ensures that cartridges will be retained within their respective chambers while the two cylinders are interchanged between loading, firing and storage positions.

The two cylinders of the dual cylinder revolver are carried within the gun frame by a "crane" that provides a novel, pivotable support structure capable of aligning either cylinder in a firing position, whereat the cylinder is aligned with the gun barrel and firing mechanism; in a storage or non-use position; and in a loading position, whereat the gun user has access to all chambers within the cylinder for loading purposes Advantageously, the crane is spring-biased to rapidly relocate a cylinder from the storage position to the firing position with the mere press of a button. This feature allows the gun user to empty a first cylinder during firing, and then immediately switch to a second cylinder for continued firing with little interruption. If desired, the two cylinders can be loaded each with a different type of ammunition so that the gun user can quickly switch ammunition types by switching cylinders. Advantageously, the unique features of the dual cylinder revolver of the present invention are compatible with standard firing mechanisms and other well-known firearm advancements. For example, the inventive ejector mechanism of the present invention would have equal utility if employed in a conventional single cylinder revolver.

Other features and advantages of the present invention will become more apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 3 is an elevational view taken along line 3—3 in FIG 1B of the rearward face of one cylinder taken along line 3—3 in FIG. 1. (i.e. the cylinder face closest to the gun grip), showing a cartridge retaining ring in engagement with cartridges in the cylinder chambers, and also showing an ejector mechanism (note that both cylinders are identically constructed, thus, FIGS. 3 and 3A. show only one cylinder for simplicity's sake);

FIG. 3A is an elevational view of the cylinder taken along the same line of sight as in FIG. 3, showing the cartridge retaining ring disengaged from the cartridges;

DETAILED DESCRIPTION OF THE PREFERRED EMBODIMENT

In accordance with the present invention, a dual cylinder revolver 10 (FIGS. 1A and 1) is provided with a first cylinder 12 and a second cylinder 14 for carrying cartridges, thereby doubling the firing capacity over that associated previously with conventional six or nine shot revolvers having a single cylinder. The cylinders 12 and 14 are identically constructed; for this reason, features highlighted hereinafter, such as the mechanism for ejecting spent cartridges from a cylinder chamber, and the means for retaining firable cartridges within a cylinder chamber, will be discussed with reference to one cylinder, with the same disclosure information also pertaining to the other identical cylinder as well.

Figure 1:
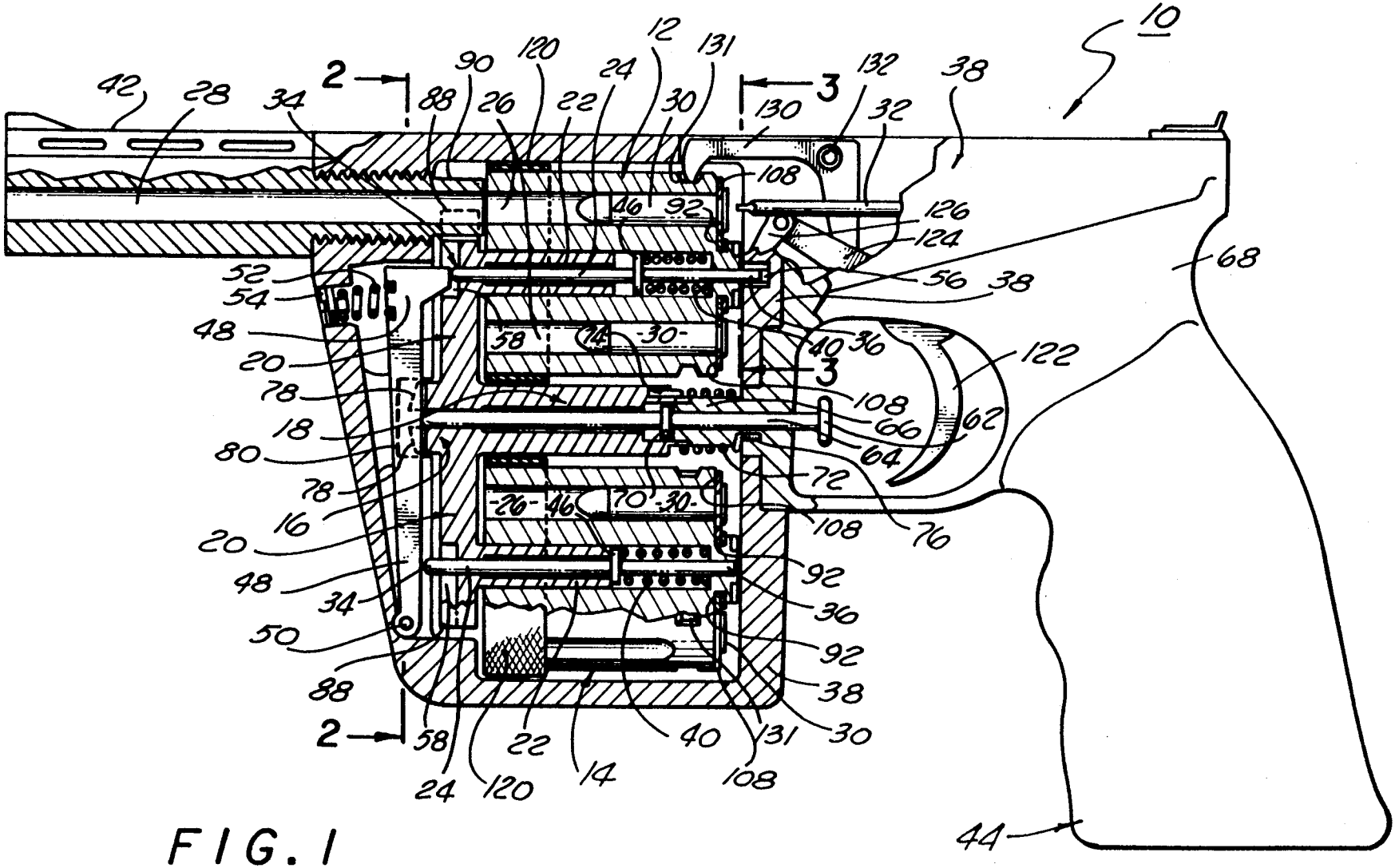
FIG. 1 is an enlarged side view, partially in cutaway, of a dual cylinder revolver embodying the invention, with said revolver being cutaway along the longitudinal axis of its barrel and through the midsection of its cylinders to reveal a crane assembly which supports the cylinders; note that the dual cylinder revolvers of FIGS. 1A and 1. each feature a different style of gun frame, gun grip, trigger arrangement and firing mechanism in order to illustrate that the inventive features of the dual cylinder revolver are compatible with a wide spectrum of conventional firearm features.
Figure 2:
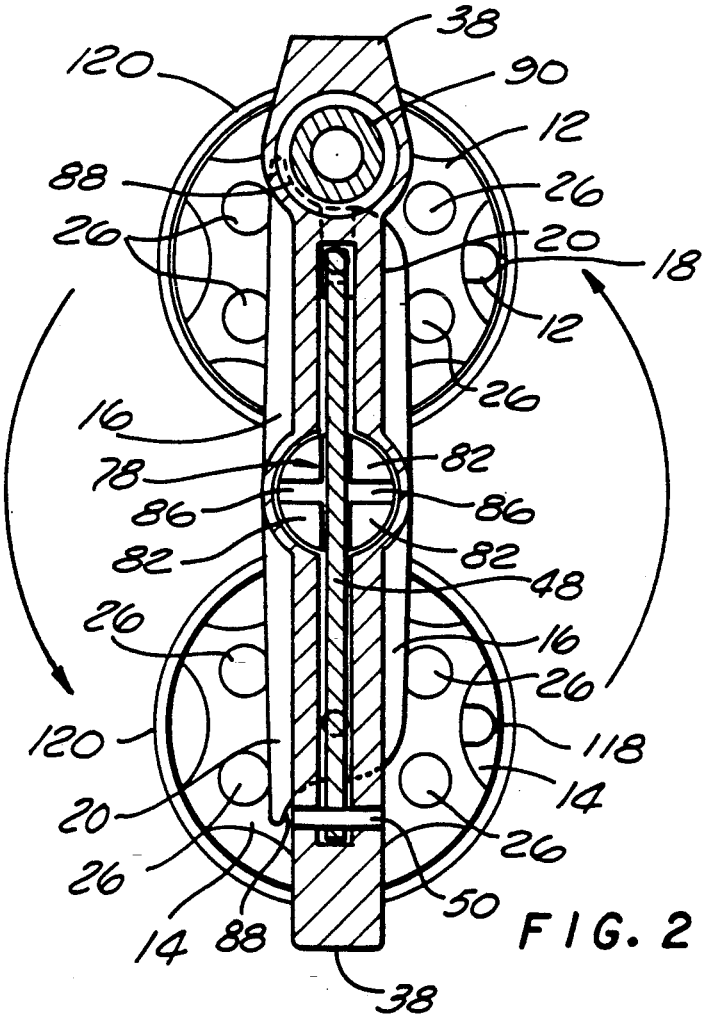
FIG. 2 is a front elevational view taken along line 2—2 of FIG. 1. of the dual cylinder revolver of FIG. 1, as seen looking at the front of the gun barrel, with portions of the gun frame omitted to emphasize the top cylinder in the firing position, the bottom cylinder in the storage position and a crane latch locking these cylinders in their respective positions.
Figure 2A:
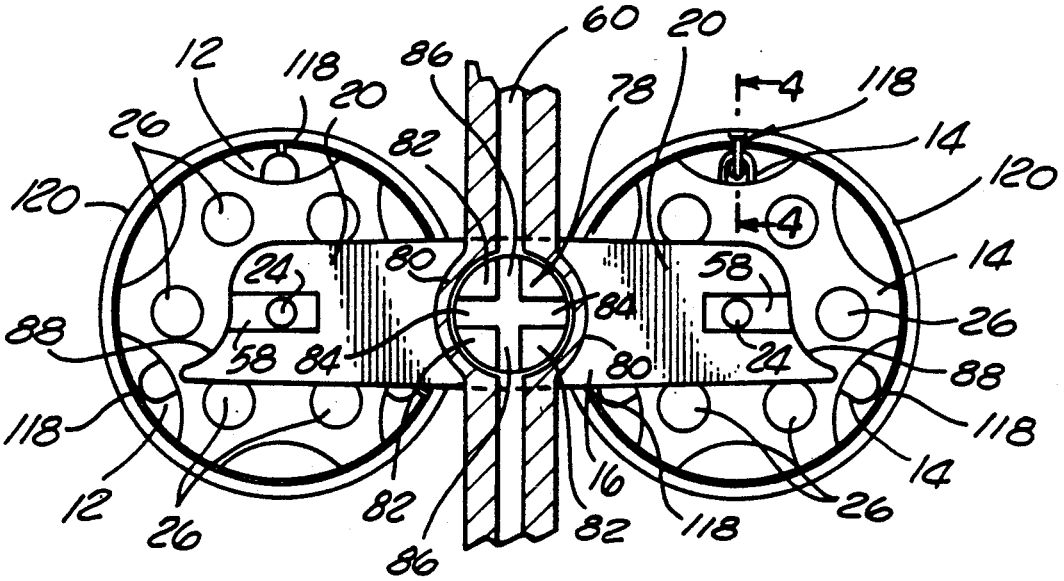
FIG. 2A. is a fragmentary front elevational view taken along a line of sight that is identical to the view of FIG. 2, with the crane latch being omitted to indicate an unlatched state that allows the cylinders to be oriented in the side-by-side loading positions of FIG. 2A.

The cylinders 12 and 14 are carried by a support structure designated as a crane 16 (best viewed in FIG. 2A). The crane 16 can be characterized as being substantially "T"-shaped, a configuration best viewed in the cross sectional view of FIG. 1*b* which shows that this "T"-shape is defined by a crane central stem 18 having integrally formed crane arms 20 extending therefrom. The crane arms 20 extend from opposite sides of one end of the central stem 18 and each arm 20 is oriented substantially perpendicular to said stem 18.

Each crane arm 20 includes a cylinder support 22 that extends from the arm at a distal end thereof (that is, an end of the arm spaced from the crane stem 18), or at a location proximate to said distal end. Each cylinder support 22 is oriented with its longitudinal axis substantially perpendicular to the longitudinal axis shared by the crane arms 20, and substantially parallel with the longitudinal axis of the crane stem 18. Each cylinder support 22 is journaled to rotatably support a cylinder 12 or 14 and a cylinder axle pin 24, upon which an associated cylinder, 12 or 14, will rotate. Preferably, the cylinder supports 22 are cylindrically shaped.

Figure 1A:
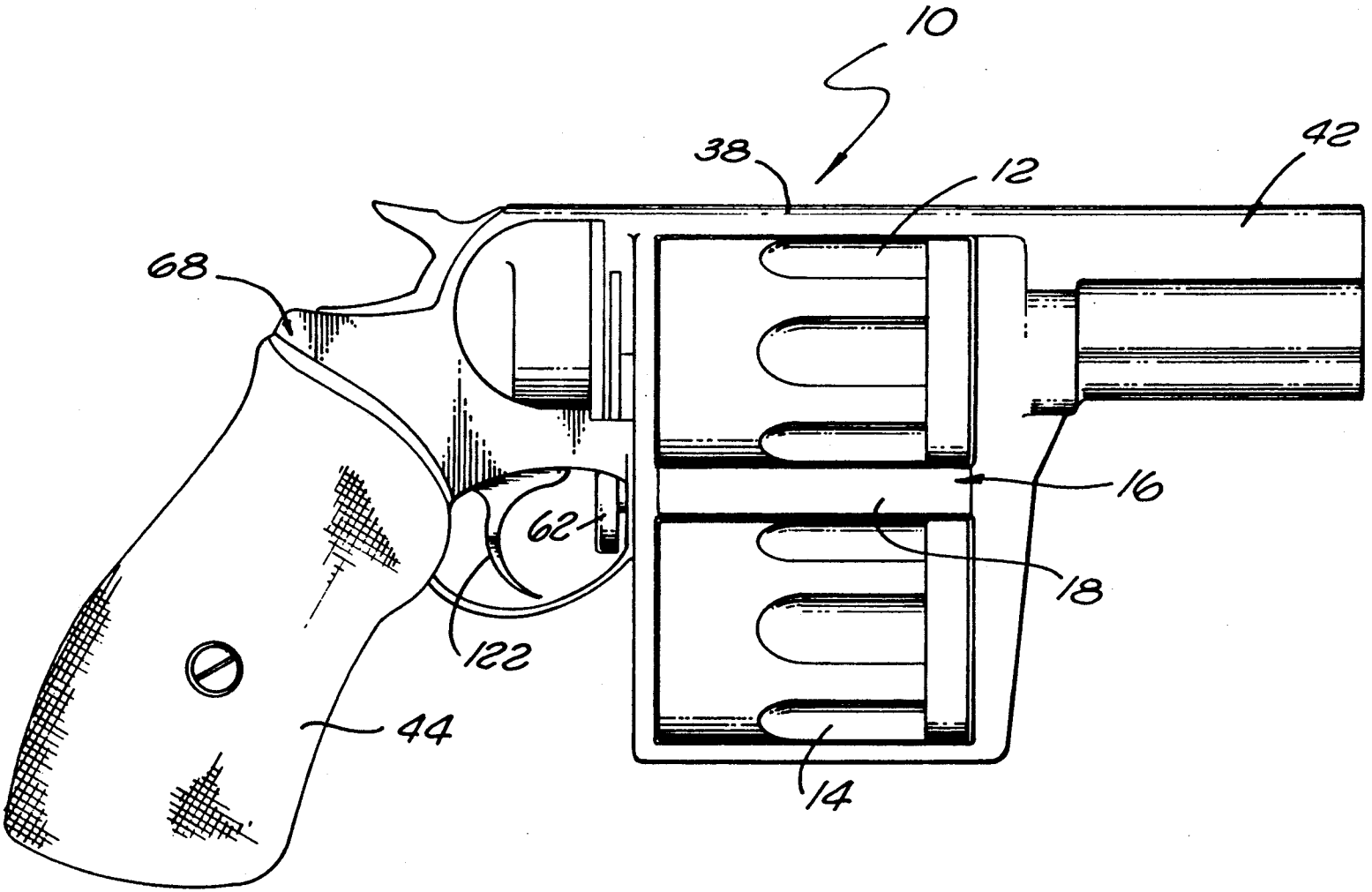
FIG. 1A. is a perspective view of a dual cylinder revolver embodying the invention.

For designation purposes, in FIG. 1, the cylinder 12, having a chamber 26 aligned with a barrel passageway 28, is said to be in the firing position. In the firing position, a cartridge 30 in a chamber 26 will be simultaneously aligned with a firing pin 32 whenever the chamber 26 is aligned with said barrel passageway 28. The cylinder 14, having no chambers 26 in alignment with the barrel passageway 28 is said to be in the storage position. Each cylinder 12 and 14 has, preferably, six annular chambers 26 bored therethrough. These chambers 26 extend longitudinally through the body of the cylinder (12 or 14), such that all chambers 26 are oriented parallel to each other and parallel to a central axis of the cylinder body. Cylinders which include more or less than six chambers 26 are considered to be within the scope of this patent. The cylinders 12 and 14 are fluted, as is conventional, to reduce the weight of the revolver 10. Each cylinder 12 and 14 is carried by the crane 16 and its associated cylinder axle pin 24 such that, when in the firing position, each cylinder is rotatable in a manner wherein rotation of the cylinder causes the chambers 26 therein to successively register in alignment with the barrel passageway 28. All chambers 26 are to be kept supplied with cartridges 30. When a chamber 26 is aligned with the barrel passageway 28, the cartridge 30 therein is ready to be discharged merely by being impacted upon by the firing pin 32.

With reference to FIG. 1, note the cylinder axle pin 24 associated with the cylinder 14. Since the cylinder 14 is in the storage position, its axle pin 24 will have a first end 34 which is slidably retained within its associated cylinder support 22 and which protrudes from its associated crane arm 20. In this storage position, the cylinder axle pin will have a second end 36 which will be biased out of abutment with the main frame 38 of the revolver 10 by action of a coil spring 40 which is retained about the end 36 of the axle pin 24. The coil spring 40 biases the axle pin 24 in a direction towards the barrel 42 along an axis substantially parallel to said barrel, and biases the axle pin in a direction away from a revolver grip 44. The coil springs 40 are accommodated within a cylindrical bore in each cylinder. Each coil spring 40 has one end abutting an interior portion of its associated cylinder (12 or 14) and has an opposite end abutting and acting upon a collar 46 provided on each cylinder axle pin 24. Each collar 46 provides stop means for limiting the biasing action of each coil spring 40 because the collar 46 limits the travel of its associated axle pin 24 in a direction away from the revolver grip 44 by ultimately abutting the distal end of an associated cylinder support 22. In this sense, each collar 46 also provides stop means for limiting the travel of its associated axle pin.

Next, note the cylinder axle pin 24 associated with the cylinder 12. Since the cylinder 12 is in the firing position, its axle pin 24 will have a first end 34 which is being acted upon by a crane latch 48. The crane latch 48 can be characterized as an elongated, pivotable, locking arm. The crane latch 48 has an integrally formed pivot pin 50 extending from its lower end. This pivot pin 50 is retained within the revolver main frame 38 in any manner allowing said crane latch 48 to pivot from a first or normal position, whereat the crane latch 48 engages an end 34 of an axle pin 24, to a second, or abnormal position, whereat the crane latch is located out of engagement with any axle pin 24 by pivotal movement of the crane latch in a direction away from the revolver grip 44. Normally, the crane latch 48 is biased towards said first position by action of a crane latch spring 52 (FIG. 1 only) having one end retained within recesses within the crane latch 48 (or attached in other conventional manners to the crane latch), and having an opposite end that is retained within a threaded bore in the main frame 38 by a screw plug 54. The screw plug 54 threads into the main frame 38 and provides a shank about which one end of the crane latch spring 52 is captured. The biasing action of the crane latch spring 52 is greater than the biasing action of each coil spring 40. For this reason, whenever a cylinder 12 or 14 is in the firing position (see cylinder 12 in FIGS. 1A and 1), its axle pin 24 will have its end 34 pressed upon by the crane latch 48. The biasing force of the crane latch spring 52 acting upon the axle pin end 34 (via the crane latch 48) will overcome the biasing action of the coil spring 40 about the axle pin end 36, thus causing the axle pin 24 to move in a direction towards the revolver grip 44. When this happens, the crane latch 48 and the crane latch spring 52 cooperatively bias the axle pin 24 such that its end 36 becomes retained within a recess 56 in the main frame 38 of the revolver 10. The retention of the axle pin end 36 within the main frame recess 56 locks the cylinder 12 (or 14) against movement out of its firing position alignment. With reference to the axle pin 24 that is in the firing position in FIG. 1, note that the coil spring 40 is compressed between the axle pin collar 46 and an interior surface of the cylinder 12 when the crane latch spring 52 exerts biasing force upon the axle pin end 34 (via the crane latch 48).

Each crane arm 20 has a slot 58 therein sized for engagement and retention of the distal end of the crane latch 48 (i.e. crane latch end opposite the pivot pin 50) therein. The slots 58 are located on the crane arms 20 such that when a cylinder 12 or 14 is aligned in the firing position, a slot 58 will correspondingly be aligned with the crane latch 48's distal end. The crane latch spring 52 also biases the crane latch 48 into engagement within an aligned slot 58, thereby locking the crane 16 against rotational movement relative to the main frame 38. The placement of the slots 58 on the crane arms 20 is such that an axle pin end 34 which is protruding from its cylinder support 22 (due to the biasing of a coil spring 40) will extend into a slot 58, thereby allowing the crane latch 48 to simultaneously abut the axle pin end 34 while being retained within a slot 58.

The view of the crane latch 48 shown in FIG. 2 reveals its narrow, thin profile, sized for temporary accommodation within a narrow slot-like crane latch passage 60 (best viewed in FIG. 2A) defined in the main frame 38 of the gun. The crane latch 48 releases the crane 16 whenever the revolver user manually presses a push rod button 62 in a direction towards the gun barrel 42. This push rod button 62 is integrally formed on one end of a crane latch push rod 64 that defines an axis about which said crane 16 rotates to move the cylinders 12 and 14 from the storage position to the firing position and vice-versa. The push rod 64 is slidably retained within a grip frame extension 66 of a grip frame 68. The grip frame extension 66 has an internal channel for this purpose. The distal end of the push rod 64 (i.e. the end opposite the push rod button 62) is slidably retained within the crane stem 18 such that the push rod 64 will protrude from the crane 16 whenever the push rod button 62 is pressed. Depression of the push rod button 62 will release the crane latch 48 from engagement within a crane arm slot 58 (and thus, from engagement with the crane 16) because force upon the push rod button 62 will be translated to the push rod 64, thereby causing the push rod 64 to slide in a direction towards the gun barrel 42, thus ultimately allowing the distal end of the push rod 64 to protrude from the crane 16 and abut with the crane latch 48. The push rod distal end then acts upon the crane latch 48 to push said crane latch in a direction away from the revolver grip 44, thus disengaging the crane latch 48 from a slot 58 in the crane 16. It will be apparent that manual force upon the push rod button 62 will have to be applied to a degree sufficient to overcome the biasing force of the crane latch spring 52. A collar 70 about a midsection portion of the push rod 64 serves as stop means for limiting the forward or backward sliding motion of the push rod 64 by abutting either the grip frame extension 66 or the crane stem 18 (depending upon the direction that the push rod 64 is sliding).

The crane stem 18 is attached to the grip frame extension 66 in any conventional manner that allows the crane 16 to rotate relative to the grip frame extension 66. A torsion spring 72 is retained about co-axially aligned, mated, portions of the crane stem 18 and the grip frame extension 66. The opposite ends of the torsion spring 72 are retained between a torsion spring stop 74 provided on the crane stem 18 and a torsion spring stop 76 provided on the grip frame extension 66 such that said torsion spring 72 will bias the crane 16 towards undergoing a rotational action wherein, upon actuation of the push rod button 62 to release the crane latch 48 from the crane 16, the torsion spring action will cause the crane to rotate a cylinder from the firing position to the storage position and also rotate a cylinder from the storage position to the firing position. The rotatable association of the crane stem 18 with the grip frame extension 66 enables the grip frame extension to serve as a rear pivot point for rotational action of the crane 16 and the cylinders 12 and 14 carried thereby. The junction of the crane stem 18 with its crane arms 20 includes an outwardly projecting portion that serves as a front pivot point for rotational action of the crane 16. This projecting portion, designated as crane alignment member 78 is indicated by dashed outline in FIG. 1. The crane alignment member 78 has a tapered or conical shaped distal end that rides within a cylindrical recess defined within the main frame 38, thereby permitting the alignment member 78 and the rest of the crane 16 to rotate relative to the main frame 38. In FIGS. 2 and 2A, the portion of the main frame 38 which interiorly defines this cylindrical recess is designated by reference numeral 80. In FIG. 1, this main frame portion 80 is shown in dashed outline.

From the foregoing, it will become apparent that crane portion 78 is deservedly named an "aligning member". Inspection of FIGS. 2 and 2A reveal that the crane alignment member 78 defines a plurality of upraised lands 82, which in turn define a pair of perpendicular (to each other) slots 84 and 86. The slot 84 aligns with the crane latch passage 60 whenever the cylinders 12 and 14 are in the firing and storage positions, respectively, as in FIG. 2, or vice versa (i.e. the cylinder 12 is in the storage position, with the cylinder 14 in the firing position). The slot 86 aligns with the crane latch passage 60 when the cylinders 12 and 14 are in the loading position, as in FIG. 2A. The slot 84 is not readily visible in FIG. 2 because said slot has been engaged by the crane latch 48. Both slots 84 and 86 are seen in FIG. 2A because the crane latch 48 has been omitted from FIG. 2A for clarity's sake. The alignment function provided by crane alignment member 78 is readily understood. When the push rod button 62 is actuated to disengage the crane latch 48 from the crane 16, the crane will begin to rotate due to biasing force supplied by the torsion spring 72. During this rotation, not only will the crane alignment member 78 pivot within the cylindrical recess defined in main frame portion 80, but also, the crane latch 48 will be maintained out of engagement with the crane 16 as said crane rotates, because the raised lands 82 on the crane alignment member 78 will space said crane latch away from its normal position (previously defined). That is, the crane latch 48 will "ride" on a land 82 as the crane 16 rotates, thus spacing the crane latch outwardly from the crane slots 58. The alignment function occurs whenever the crane alignment member 78 (and the rest of crane 16) rotate to an orientation whereat said crane latch 48 will slide off a land 82 and fall into engagement within a slot 84 or 86 in the alignment member 78. In this manner, the crane latch 48 halts rotation of the crane 16 at either a location whereat the cylinders 12 and 14 are aligned in the firing/storage positions (FIG. 2) (occurring when crane latch 48 is engaged by aligning slot 84), or at a location whereat the cylinders are aligned in the loading position (FIG. 2A) (occurring when the crane latch 48 is engaged by aligning slot 86). Whenever the crane latch 48 falls into the slot 84, said latch 48 will simultaneously engage a slot 58 in a crane arm 20. Thus, through cooperation with the crane latch 48, the slots 84 and 86 serve to align the crane 16 in a firing/storage position, and a loading position, respectively.

Another alignment feature of the crane 16 is a pair of curved crane stops 88 provided at the distal ends of each crane arm 20. The curvature of the concave portion of each crane stop 88 should mate with the curvature of a cylindrical barrel extension 90 which threads into the main frame 38. The crane stop 88 proximate the cylinder 12 in FIG. 1 is abutting the barrel extension 90 to provide a limit to the rotational path traveled by the crane 16, while the crane stop 88 proximate the cylinder 14 in FIG. 1 is disengaged from abutment with any portion of the main frame 38 or barrel 42. The situation depicted in FIG. 1b is also shown in FIG. 2, with the crane stops 88 being depicted in dashed outline therein. Using FIG. 2 as a reference, when the torsion spring 72 rotates the lower cylinder 14 from the storage position to the firing position, the lower crane stop 88 will rotate (see motion arrows in FIG. 2) upwardly until finally abutting the barrel extension 90 (not visible in FIG. 2). At that point the crane stop 88 will function as stop means to limit further rotational action of the crane in the same direction. The torsion spring 72 is for rotating cylinders 12 and 14 between the storage and firing positions. The loading position of FIG. 2A, whereat both cylinders are located outwardly from the main frame 38 and to either side thereof, is achieved by manually releasing the crane latch 48 (using the push rod button 62), and then manually rotating the crane 16 against the biasing action of the torsion spring 72 (i.e. in the direction opposite of the motion arrows in FIG. 2) until the crane 16 is locked in the loading position by engagement of the crane latch 48 within the slot 86 in the crane alignment member 78. The engagement of the crane latch 48 within the slot 8 prevents the torsion spring 72 from biasing the crane 16 to a firing/storage position. In the loading position, a user will gain easy access to all chambers 26 in both cylinders 12 and 14, thereby readily allowing for the ejection of spent cartridges and the insertion of fresh cartridges therein.

When the torsion spring 72 is rotating the crane 16, means are provided to prevent the cartridge 30 from inadvertently falling out of the cylinders 12 and 14. A cartridge retaining ring 92 is provided to serve as means for retaining the cartridges 30 within their respective chambers 26. The cartridge retaining ring 92 has six beveled engagement tabs 94 (best viewed in FIG. 3A) spaced equidistantly apart at locations proximate to its perimeter. These engagement tabs 94 are provided in a number equal to the number of chambers 26 found in each cylinder.

Figure 6:
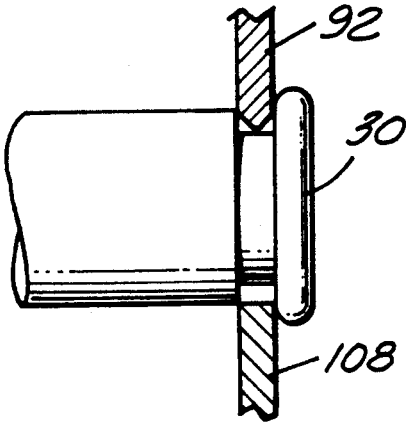
FIG. 6 is an enlarged fragmentary cross-sectional view taken generally along line 6—6 of FIG. 3 illustrating engagement of both the cartridge retaining ring and the ejector ring with a cartridge (also shown in fragment)
Figure 7:
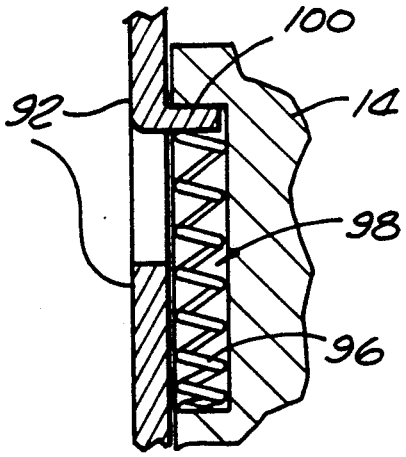
FIG. 7 is an enlarged, fragmentary cross-sectional view taken generally along line 7—7 of FIG. 3, illustrating the manner in which springs are retained within the cylinder to provide a biasing force upon the cartridge retaining ring.

Each tab 94 has a curved portion which engages beneath the flange of a cartridge head, as seen in FIG. 6. Since the tabs 94 engage the cartridges 30, the tabs 94 should have curved portions which have curvatures suitable for mating about the cylindrical cartridge exterior. In FIG. 3, the cartridge retaining ring 9 is shown retaining six cartridges 30 within their respective chambers. The retaining ring 92 is biased into this engagement by a plurality of coil springs 96. As best viewed in FIG. 7, each spring 96 is retained within a spring channel 98 in an end face of a cylinder (12 or 14), and has one end abutting an interior wall of the spring channel 98 and an opposite end abutting, and exerting a biasing action against, a tang 100 extending from the cartridge retainer ring 92 into the spring channel 98.

In order to limit the range of motion of the cartridge retainer ring 92, stop means on the cylinder, such as pins 102 (FIGS. 3 and 3A), project into, and are slidably retained within, slots 104 in the retainer ring 92. Whenever a pin 102 abuts an end of a slot 104, the retainer ring 92 is prohibited from moving further in the same direction. The cartridge retainer ring 92 is secured to its associated cylinder by a clip 106. In FIG. 3A, the cartridge retainer ring 92 has been rotated (manually, in a manner unseen) to an orientation whereat none of its engagement tabs 94 are engaged with a cartridge 30. The retainer ring 92 is manipulatable into the FIG. 3A orientation in order to allow for easy loading of the cartridges 30 into the chambers 26. However, even in the absence of a preliminary loading step of manipulating the retainer ring 92 into the FIG. 3A orientation, loading is not prohibited. This is because during initial cartridge insertion, the action of the nose portion of a cartridge against a tab 94 (which is beveled) will provide sufficient impetus to rotate the retainer ring 92 out of the way (as in FIG. 3A), thereby allowing for full insertion of the remainder of the cartridge body into the desired chamber 26. Engagement of a tab 94 with a cartridge 30 is best depicted in FIG. 3, wherein a cartridge 30 has been cut away to reveal this engagement. It must be noted that the cartridge retainer ring 92 in no way hinders the firing of a cartridge through the barrel passageway 28, but rather, merely prevents cartridges from falling out of their chambers 26, when applicable, such as when cylinder 14 travels from the storage to the firing position.

Figure 4:
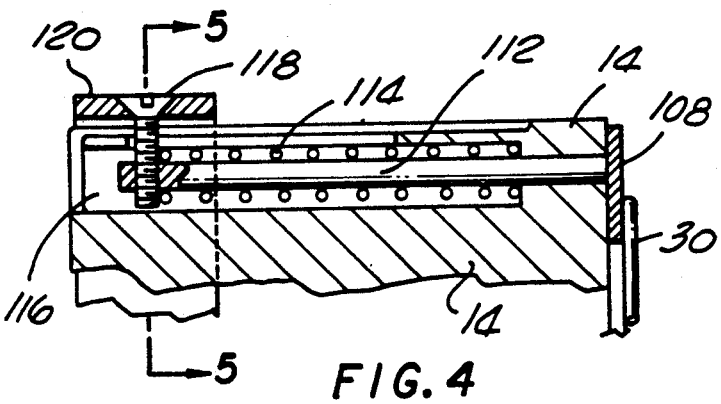
FIG. 4 is a fragmentary cross-sectional view of a cylinder taken generally along line 4—4 of FIG. 2A, illustrating a screw and ejector push bar which link an ejector grip ring with a spring-biased ejector ring.

In order to allow for rapid removal of spent cartridges 30 following firing, each cylinder 12 and 14 has a novel cartridge ejection mechanism. The ejection mechanism is best viewed in FIGS. 3–5, and comprises an ejector ring 108 which rests beneath flange portions of the cartridges 30 (in a manner best viewed in FIG. 6). The ejector ring 108 includes curved cut-outs 110 (visible only in dashed outline in FIGS. 3 and 3A) having a curvature suitable for mating with the cylindrical cartridge exterior. These cut-outs 110 partially encircle a cartridge portion beneath the cartridge rim. Whereas the cartridge retainer ring 92 engages cartridge portions facing towards the cylinder axle pin 24, the ejector ring cut-outs 110, in contrast, engage cartridge portions facing towards the cylinder perimeter (i.e. facing away from the axle pin 24).

Figure 4A:
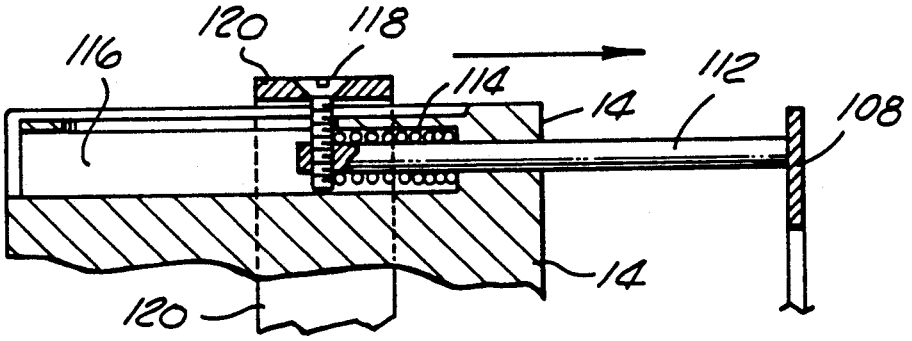
FIG. 4A is a fragmentary (the cylinder is a fragment in FIGS. 4, 4A and 5), cross sectional view of a cylinder, said view being similar to the view of FIG. 4 except that in FIG. 4A, the ejector grip ring has been moved (in the direction of the movement arrow) to space the ejector ring outwardly from the cylinder.

Each ejector ring 108 has, integrally formed therewith, and perpendicularly extending therefrom, an ejector push bar 112 (see FIGS. 4 and 4A) which has a coil return spring 114 retained about a portion thereof. The distal end of each ejector push bar 112 (that is the end furthest from the ejector ring 108) is slidably retained within a spring channel 116 provided within each cylinder 12 and 14 (and not visible within FIG. 1). The return spring 114 has one end in abutment with an inner surface of the spring channel 116 and has an opposite end in abutment with a screw 118 which passes through cylinder opening 117 (which is in communication with the spring channel 116) and attaches the ejector push bar 112 with an ejector grip ring 120. The return spring 114 encircles the push bar 112 and, by acting upon the screw 118, biases the push bar 112, the ejector ring 108, and the ejector grip ring 120 (all three move as a unit) into the normal position shown in FIG. 4. At this normal position, the cartridge 30 remains within its chamber, with the ejector ring 108 beneath said cartridge, poised to execute ejection of the cartridge, once spent. Once all cartridges in both cylinders 12 and 14 have been fired, it will be necessary to eject empty shells. To accomplish this, one manipulates the crane 16 into the loading position (by first releasing the crane latch 48 by pressing the push rod button 62) of FIG. 2A. In the loading position the ejector grip rings 120 (each of which encircles a cylinder 12 or 14) are easily grasped by the user and then pulled in the direction of the motion arrow in FIG. 4A (i.e. in a direction towards the gun grip 44). Manual movement of the ejector grip ring 120 in said direction will overcome the biasing force of the return spring 114 (note how the return spring 114 is compressed in FIG. 4A as opposed to its normal configuration in FIG. 4) and will extend the ejector push bar 112 outwardly from the cylinder 14 (or 12), thereby also relocating the ejector ring 108 rearwardly and outwardly from its associated cylinder. Such relocation of the ejector ring 108 (as in FIG. 4A) towards its abnormal position will correspondingly eject from the cylinder chambers any cartridges 30 which were previously engaged by the ejector ring 108. Moreover, the ejection force (i.e. the ejecting pull exerted upon the cartridges by the ejector ring 108) will act upon the beveled engagement tabs 94 of the cartridge retaining ring 92 in a manner sufficient to overcome the biasing force of the coil springs 96, thereby causing the cartridge retaining ring 92 to rotate out of engagement with the cartridges 30 to a degree sufficient to allow the ejecting step to proceed.

Figure 5:
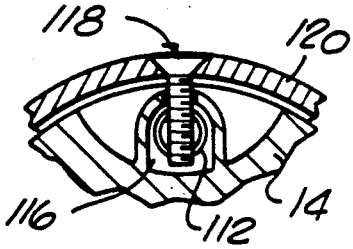
FIG. 5 is a fragmentary cross-sectional view taken generally along line 5—5 of FIG. 4, further illustrating the manner in which the screw links the ejector grip ring to the ejector push bar.

FIG. 5 details the manner in which the screw 118 joins the ejector grip ring 120 to the push bar 112. Towards this end, the screw 118 passes through an aperture in the ejector grip ring 120, then through an aperture in the cylinder which leads into the spring channel 116, before finally threading into engagement within a threaded port in the distal end of the ejector push bar 112. The head of the screw 118 should be flush with the exterior surface of the ejector grip ring 120. The ejection mechanism of the present invention is an inventive departure from a conventional ejector rod which typically extends from a forward cylinder portion in conventional revolvers. Moreover, the ejector push bars 112 need not slide within the spring channels 116, but, alternatively, said push bars can be slidably retained within longitudinal grooves provided in the exterior surface of the cylinders. The function of the return springs 114, namely to prevent unintended cartridge ejection, can alternatively be provided by any friction detente arrangement which normally maintains the ejector ring 108 in the orientation shown in FIG. 4. The ejector mechanism disclosed herein can be adapted for use in conventional, single-cylinder revolvers; its use is not limited to the dual cylinder revolver 10.

Many conventional revolver features either are or can be employed in the dual cylinder revolver 10. The present invention does not encompass such conventional features, thus said features will be left undescribed because they are well known to those skilled in the gun-making art. For example, the illustration (FIG. 1) depicts a revolver having a concealed hammer. This revolver could alternatively feature an exposed hammer arrangement which is conventional. Alternatively, the revolver 10 can be striker fired (which is another conventional approach that does not involve use of a hammer). In FIG. 1, the concealed hammer (unseen for clarity's sake) would actuate the firing pin 32 to impact upon an aligned cartridge 30 and fire said cartridge through the barrel passageway 28. Besides incorporating conventional firing mechanisms, the dual cylinder revolver 10 can employ conventional safety mechanisms such as a transfer bar type of safety, a hammer block safety, or a firing pin block safety, all of which are known to those skilled in the art.

Advancement of the cylinder (12 or 14) and firing of the revolver 10 is accomplished as follows. Whenever one pulls the trigger 122 (FIG. 1), a trigger arm 124 operatively associated therewith will manipulate a pawl 126 to advance the cylinder such that a new chamber 26 will be brought into alignment with the barrel passageway 28. Rotation of the cylinder occurs when the pawl 126 (manipulated by the trigger 122 via the trigger ar 124) engages with the next succeeding ratchet tooth or notch of a ratchet star 128. In regard to the operation of the firing mechanism, the initial motion of the firing mechanism (comprising the trigger 122 and the hammer (not visible)) lifts the timing hand 130 out of engagement with a cylinder notch 131 through manipulative action provided by links and levers operatively associated (in any appropriate manner known to those skilled in the art) with the firing mechanism, thereby freeing the cylinder for rotation. Upon retraction of the trigger 122 or hammer (not shown), the pawl 126 will engage the ratchet star 128 and will rotate said rachet star which will in turn rotate the cylinder (12 or 14) that has just been unlocked by disengagement of the timing hand 130, thereby bringing a loaded chamber 26 in line with the barrel passageway 28 just prior to the release of the firing hammer (unseen) and its subsequent actuation of the firing pin 32. When the firing hammer is released, it will strike the firing pin 32 to explode the cartridge aligned therewith. Upon alignment of a cylinder chamber 26 with the barrel passageway 28 and just before the firing hammer is released to strike the firing pin 32, the timing hand 130 (FIG. 1) will engage one of a plurality of notches 131 in the exterior of the cylinder, so as to lock said cylinder with a chamber 26 in alignment with the barrel passageway 28, while also locking said cylinder against any rotation during the actual explosion of the fired cartridge. Towards this end, the timing hand 130 is pivotable about a pivot point 132 and is spring biased (spring not shown) towards engagement against the cylinder. Upon each retraction of the trigger 122, this operation will be repeated until all the cartridges contained in the chambers of the cylinder have been fired. Then the user switches to a loaded cylinder 14 which was previously in the storage position by rotating the loaded cylinder 14 into the firing position using the previously described method.

From the foregoing, it will be appreciated that the dual cylinder revolver of the present invention advantageously provides for increased firing capacity while also allowing a user to choose between two different ammunition types on demand. Moreover, the two different ammo types are loaded into two separate cylinders, respectively, so as to avoid any confusion. Further, the present invention desirably features a novel cartridge ejector mechanism as well as a cartridge retaining mechanism. Finally, the geometry of the inventive dual cylinder revolver, with its trigger behind the cylinders rather than below a cylinder, advantageously lowers the barrel line relative to the hand, thus effectively reducing the effects of recoil upon firing.

While a particular form of the invention has been illustrated and described, it will be apparent that various modifications can be made without departing from the spirit and scope of the invention. Accordingly, it is not intended that the invention be limited, except as by the appended claims.

We claim:

1. A revolver comprising:

a frame provided at a rear end thereof with a pistol grip and at a front end thereof with a forwardly projecting barrel;

a first cylinder having a plurality of cartridge chambers therein, said first cylinder being rotatable within said frame about a first axle paralleling said barrel;

a second cylinder having one or more cartridge chambers therein, said second cylinder being rotatable within said frame about a second axle paralleling said barrel;

a crane pivotably attached to said frame by a shaft, said shaft providing an axis around which said crane pivots, said shaft being located between said first and second cylinders and being parallel to said barrel and said first and second axles, wherein said crane comprises a body having a central stem paralleling said barrel, said stem having first and second crane arms extending therefrom, with distal ends of said first and second crane arms defining first and second ends, respectively, of said crane, wherein said first and second axles are supported by said first and second crane arms, respectively, and wherein said shaft is accommodated, at least in part, within said central stem, said crane providing support means for carrying said first and second cylinders, said crane being selectively pivotable to a first crane position whereat said first cylinder is located in a firing position and said second cylinder is located in a storage position, to a second crane position whereat said first cylinder is located in the storage position while said second cylinder is located in the firing position, and to a third crane position whereat both cylinders are supported in a loading position whereat the crane supports each cylinder such that said cylinders are spaced outwardly from the frame to allow access to the chambers of each cylinder for cartridge loading therein, wherein a cylinder located in the firing position will have a cartridge chamber aligned with said barrel, and wherein a cylinder in the firing position is rotatable about its axle to a multiplicity of rotary positions in which a respective chamber thereof is aligned with said barrel;

a firing mechanism carried by said frame, said firing mechanism including a trigger and a firing pin that is operatively associated with, and actuated by, said trigger, wherein a cylinder in the firing position will have a cartridge chamber aligned with said firing pin;

means for rotating whichever cylinder is in the firing position, said rotating means being associated with said frame and operated by a retraction of the trigger to advance a cylinder in the firing position from one rotary position to the next rotary position to successively present cartridges in its chambers for firing; and detent means engageable with whichever cylinder is in the firing position for arresting same in any of its rotary positions, said detent means being coupled with said trigger for temporarily disengaging from said cylinder in the firing position during a retraction of said trigger.

2. A revolver as set forth in claim 1, wherein the number of cylinders does not exceed two.

3. A revolver as set forth in claim 1, wherein said crane supports each cylinder in a loading position whereat said cylinders are spaced outwardly from the frame on opposite sides thereof.

4. A revolver as set forth in claim 1, wherein said first and second crane arms are parallel with the longitudinal axis of said crane arms and said central stem is oriented substantially perpendicular to said vertical axis, wherein whenever said crane is oriented in the first or second crane positions, the crane is accommodated within the frame such that the longitudinal axis of the crane arm is vertically oriented when a longitudinal axis through the barrel is horizontally oriented.

5. A revolver as set froth in claim 4, wherein whenever said crane is oriented in the third crane position, the longitudinal axis of the crane arms is substantially horizontally oriented when the longitudinal axis through the barrel is horizontally oriented, and wherein, in the third crane position, the first and second arms of the crane lie on opposite sides of the frame and project outwardly therefrom.

6. The revolver as set forth in claim 1, further including means for locking the crane in the first and second crane positions.

7. The revolver as set forth in claim 1, wherein said first axle is associated with said first crane arm such that said first axle is movable between an unlocked position and a locking position, and wherein said second axle is associated with said second crane arm such that said second axle is also movable between an unlocked position and a locking position, and wherein a cylinder in the firing position having its axle in the locking position will be retained in said firing position by engagement of its axle within a recess provided in said frame, wherein when said first cylinder is in said firing position, said recess and said first axle cooperatively define, at least in part, means for locking the crane in the first crane position, and wherein when said second cylinder is in said firing position, said recess and said second axle cooperatively define, at least in part, means for locking the crane in the second crane position.

8. The revolver as set forth in claim 7, further including biasing means for urging the first and second axles towards their unlocked positions.

9. The revolver as set forth in claim 8, further including a crane latch pivotally mounted to said frame such that said crane latch is pivotable to a latched position whereat said crane latch will act upon an axle to move said axle into its locking position in engagement within said recess, said crane latch also being pivotable to an unlatched position whereat said crane latch allows both axles to maintain unlocked positions out of engagement with said recess.

10. The revolver as set forth in claim 9, wherein said crane latch comprises an elongated member pivotally mounted to said frame such that said member is oriented substantially perpendicular to said barrel, said first and second axles, and said shaft, when said latch is in the latched position.

11. The revolver as set forth in claim 9, further including means for biasing the crane latch towards the latched position.

12. The revolver as set forth in claim 9, wherein at least a portion of said shaft is slidably accommodated within said central stem.

13. A revolver as set forth in claim 1, further including means for ejecting spent cartridges from the cylinder chambers.

14. A revolver as set forth in claim 13, wherein said ejecting means comprises:

a cartridge engaging member that is associated with a cylinder and that is locatable in a normal position, whereat said member provides means for engaging said cartridges while said cartridges are accommodated within their respective chambers, said cartridge engaging member also being movable to an ejection position, whereat said cartridge engaging member is spaced outwardly from its associated cylinder, wherein movement of said cartridge engaging member from the normal position to the ejection position causes cartridges engaged by said cartridge engaging member to be ejected from their respective chambers by said cartridge engaging member;

a manually operable grip element, said grip element being operatively associated with said cartridge engaging member such that said grip element provides means for manipulating said cartridge engaging member from its normal position to said ejection position; and means for biasing said cartridge engaging member to maintain its normal position, said biasing means being overcome whenever the grip element is manipulated to move said cartridge engaging member from its normal position to the ejection position.

15. A revolver as set forth in claim 14, wherein said grip element comprises:

a sleeve that is curved to correspond with external curvature of an associated cylinder, said sleeve encompassing its associated cylinder about at least a portion of a curved exterior surface of said associated cylinder, said sleeve being slidably retained along said exterior surface of its associated cylinder to enable said grip element to slide from the normal position to the ejection position; and means for operatively associating said sleeve with said cartridge engaging member.

16. A revolver as set forth in claim 15, wherein said means for associating the sleeve with the cartridge engaging member comprises at least one connecting rod that is slidably retained within a channel, defined within the associated cylinder, said connecting rod being oriented substantially parallel with the axle of said associated cylinder, said connecting rod having a first end that is joined to said cartridge engaging member and a second end that is attached to said grip element, wherein said biasing means comprises a spring provided about said connecting rod.

17. A revolver as set forth in claim 15, wherein said sleeve comprises a ring that encircles the exterior of its associated cylinder.

18. A revolver as set forth in claim 16, wherein said associating means further includes means for attaching the second end of the connecting rod to said grip element, and wherein said spring about said connecting rod has a first spring end in abutment with an interior cylinder surface that defines at least in part, said channel, wherein said spring also has a second spring end, and wherein said means for attaching the second end of the connecting rod to the grip element also provides means for retaining the second spring end about said connecting rod.

19. A revolver as set forth in claim 1, further including means for retaining cartridges within their respective cylinder chambers while said crane pivots from said first crane position to said second crane position.

20. A revolver comprising:

a frame provided at a rear end thereof with a pistol grip and at a front end thereof with a forwardly projecting barrel;

at least one cylinder having a plurality of cartridge chambers therein, said at least one cylinder being rotatable within said frame about an axle paralleling said barrel;

a firing mechanism carried by said frame, said firing mechanism including a trigger and a firing pin that is operatively associated with, and actuated by, said trigger;

means for rotating said at least one cylinder, said rotating means being associated with said frame and operated by a retraction of the trigger to advance said cylinder from one rotary position to the next rotary position to successively present cartridges in its chambers for firing;

detent means engageable with said at least one cylinder for arresting same in any of its rotary positions, said detent means being coupled with said trigger for temporarily disengaging from said cylinder during a retraction of said trigger; and means for ejecting spent cartridges from the cylinder chambers, said ejecting means comprising:

a cartridge engaging member that is associated with said at least one cylinder and that is locatable in a normal position, whereat said member provides means for engaging said cartridges while said cartridges are accommodated within their respective chambers, said cartridge engaging member also being movable to an ejection position, whereat said cartridge engaging member is spaced outwardly from its associated cylinder, wherein movement of said cartridge engaging member from the normal position to the ejection position causes cartridges engaged by said cartridge engaging member to be ejected from their respective chambers by said cartridge engaging member;

a manually operable grip element, said grip element being operatively associated with said cartridge engaging member, wherein said grip element provides means for manipulating said cartridge engaging member from its normal position to said ejection position, said grip element comprising a sleeve that is curved to correspond with external curvature of an associated cylinder, said sleeve comprising a ring that encircles the exterior of its associated cylinder, said sleeve being slidably retained along said exterior surface of its associated cylinder to enable said grip element to slide from the normal position to the ejection position; and means for operatively associating said sleeve with said cartridge engaging member.

21. A dual cylinder revolver comprising:

a frame provided at a rear end thereof with a pistol grip and at a front end thereof with a forwardly projecting barrel;

a first cylinder having a plurality of cartridge chambers therein, said first cylinder being rotatable within said frame about a first axle paralleling said barrel;

a second cylinder having one or more cartridge chambers therein, said second cylinder being rotatable within said frame about a second axle paralleling said barrel;

a crane pivotably attached to said frame, said crane providing support means for carrying said first and second cylinders, said crane comprising a body having a central stem paralleling said barrel, said stem having first and second crane arms extending therefrom, with distal ends of said first and second crane arms defining first and second ends, respectively, of said crane, wherein said first and second axles are supported by said first and second crane arms, respectively, said crane being selectively pivotable to a first crane position whereat said first cylinder is located in a firing position and said second cylinder is located in a storage position, to a second crane position whereat said first cylinder is located in the storage position while said second cylinder is located in the firing position, and to a third crane position whereat the longitudinal axis of the crane is substantially horizontally oriented when the longitudinal axis through the barrel is horizontally oriented, wherein, in the third crane position, the first and second arms of the crane lie on opposite sides of the frame and project outwardly therefrom such that both cylinders are supported in a loading position whereat the crane supports each cylinder such that said cylinders are spaced outwardly from the frame on opposite sides thereof to allow access to the chambers of each cylinder for cartridge loading therein, wherein a cylinder located in the firing position will have a cartridge chamber aligned with said barrel, and wherein a cylinder in the firing position is rotatable about its axle to a multiplicity of rotary positions in which a respective chamber thereof is aligned with said barrel;

a firing mechanism carried by said frame, said firing mechanism including a trigger and a firing pin that is operatively associated with, and actuated by, said trigger, wherein a cylinder in the firing position will have a cartridge chamber aligned with said firing pin;

means for rotating whichever cylinder is in the firing position, said rotating means being associated with said frame and operated by a retraction of the trigger to advance a cylinder in the firing position from one rotary position to the next rotary position to successively present cartridges in its chambers for firing; and detent means engageable with whichever cylinder is in the firing position for arresting same in any of its rotary positions, said detent means being coupled with said trigger for temporarily disengaging from said cylinder in the firing position during a retraction of said trigger.

22. A revolver as set forth in claim 21, further including means for releasibly locking said crane in the third crane position, such that said crane is lockable while supporting the cylinders in the loading position whereat the cylinders are spaced outwardly from the frame on opposite sides thereof.

* * * * *